US010004321B2

(12) United States Patent
Stewart

(10) Patent No.: US 10,004,321 B2
(45) Date of Patent: Jun. 26, 2018

(54) SANDAL CARRYING APPARATUS

(71) Applicant: Donna Mae Stewart, Pittsboro, NC (US)

(72) Inventor: Donna Mae Stewart, Pittsboro, NC (US)

( * ) Notice: Subject to any disclaimer, the term of this patent is extended or adjusted under 35 U.S.C. 154(b) by 141 days.

(21) Appl. No.: 15/073,842

(22) Filed: Mar. 18, 2016

(65) Prior Publication Data

US 2017/0027312 A1 Feb. 2, 2017

Related U.S. Application Data

(60) Provisional application No. 62/199,466, filed on Jul. 31, 2015.

(51) Int. Cl.
*A45F 5/06* (2006.01)
*A45F 5/02* (2006.01)

(52) U.S. Cl.
CPC ..... *A45F 5/06* (2013.01); *A45F 5/02* (2013.01); *A45F 5/021* (2013.01); *A45F 2200/05* (2013.01)

(58) Field of Classification Search
CPC .... A45F 5/06; A45F 5/02; A45F 5/021; A45F 2200/05; A45F 2200/0566; Y10S 224/904
See application file for complete search history.

(56) References Cited

U.S. PATENT DOCUMENTS

| | | | | | |
|---|---|---|---|---|---|
| 873,553 | A * | 12/1907 | Johnson | F16B 45/02 | 16/259 |
| 3,417,761 | A * | 12/1968 | Kulnis | A45D 8/14 | 132/284 |
| 4,896,806 | A * | 1/1990 | Sanchez, Jr. | A01K 97/10 | 224/200 |
| 6,193,125 | B1 * | 2/2001 | Grover | A45F 5/02 | 224/195 |
| 6,729,517 | B2 * | 5/2004 | Grover | A45F 5/02 | 224/195 |
| D554,377 | S * | 11/2007 | Therrio | D6/315 | |
| 2008/0054663 | A1 * | 3/2008 | Van Allen | A45F 5/02 | 294/145 |
| 2010/0252592 | A1 * | 10/2010 | McKinney | A45F 5/06 | 224/255 |
| 2013/0221040 | A1 * | 8/2013 | Wright | A47G 25/005 | 223/85 |
| 2016/0302559 | A1 * | 10/2016 | Khan | A45F 5/06 | |

* cited by examiner

*Primary Examiner* — Corey Skurdal

(57) ABSTRACT

A clip on sandal tote that allows a user to carry sandals on their person instead of having to be carried in the user's hands.

12 Claims, 5 Drawing Sheets

SANDAL CARRYING APPARATUS

CROSS-REFERENCE TO RELATED APPLICATION

This application claims the benefit of priority of U.S. provisional application No. 62/199,466, filed Jul. 31, 2015 the contents of which are herein incorporated by reference.

BACKGROUND OF THE INVENTION

The present invention relates to beach and leisure foot wear and, more particularly, to carriers for footwear.

Currently in the art of beach and leisure footwear, a user that would like to walk bare foot, such as on a beach, must carry their footwear. This can be inconvenient, as the user may want or need to use their hands.

As can be seen, there is a need for an apparatus that allows a person to conveniently carry their leisure footwear hands free.

SUMMARY OF THE INVENTION

In one aspect of the present invention, a sandal tote includes: an elongate base member having a front surface and a back surface; a pair of hangers having a first end attached to the base member front surface, the pair of hangers extending outwardly and outwardly from the base member front surface; a pivoting latch assembly having pair of diverging latch arms pivotally disposed to a pivot arm, wherein the latch arms are operable between an open position and a closed position. In the closed position a second end of the pair of latch arms are in abutment with an upper end of the pair of hangers. In the open position the second ends of the pair of latch arms are positioned towards the base member. The pivoting latch assembly may include a spring to bias the pair of latch arms in the closed position. An angled face may be defined on a second end of the pair of hangers and angled to face towards the front surface of the base member. A complementary angled face may be defined on a second end of the latch arms angled to abut with the angled face of the pair of hangers. The sandal tote may also include a retaining clip attached to a back surface of the base member. In a preferred embodiment of the invention, the base member is formed in the shape of a sandal sole. Similarly, the latch assembly is preferably formed in an inverted generally Y shape, with the pair of diverging latch arms forming the arms of the Y and the pivot arm forming the base of the inverted Y.

Other aspects of the invention include a tote assembly, including: a base member formed in the shape of a sandal sole; a plurality of hangers extending upwardly from a front surface of the base member; and a latch assembly attached to a front surface of the base member. The latch assembly includes a plurality of diverging latch arms having a first end pivotally attached to a pivot post and a second end biased in abutment with an upper end of the plurality of hangers in a closed position. The tote assembly may also include a retaining clip attached to a back surface of the base member. In some embodiments, an angled face is defined on a second end of the pair of hangers and is angled to face towards the front surface of the base member. Likewise, a complementary angled face may be defined on a second end of the latch arms and are angled to abut with the angled face of the pair of hangers. The plurality of diverging latch arms are operable towards the base member to an open position.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a convenient sandal tote that a user may attach to an article of clothing for convenient, hands free carrying of their leisure footwear, such as sandals, flip-flops, and the like.

Figure 1:
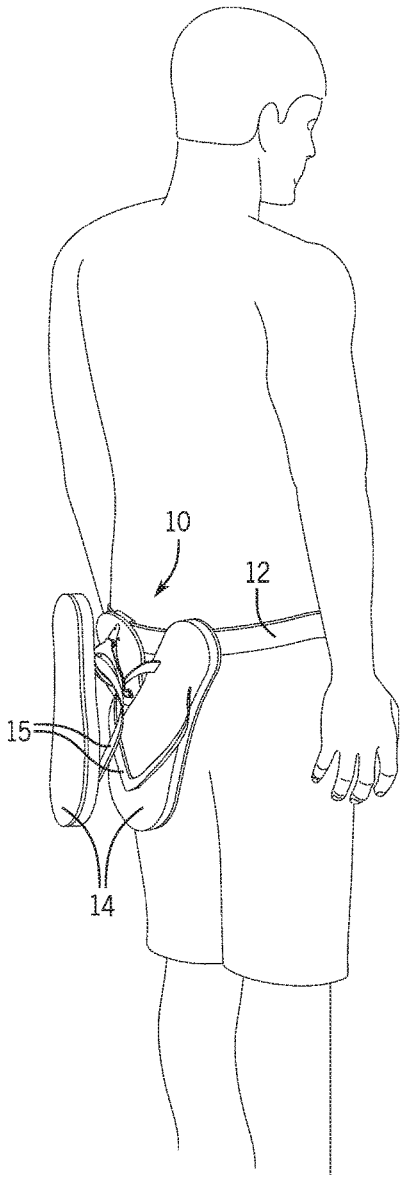
FIG. 1 is a rear perspective view of the sandal tote in use.

As best seen in reference to FIG. 1, a sandal tote 10 according to the present invention, may be attached to an article of clothing 10, such as a belt, waistband, pocket, and the like, worn by the user. The sandal tote 10 is configured to carry a pair of sandals 14, of other leisure footwear, by retaining engagement with a sandal strap 15 or other suitable attachment point of the leisure footwear 14.

Figure 2:
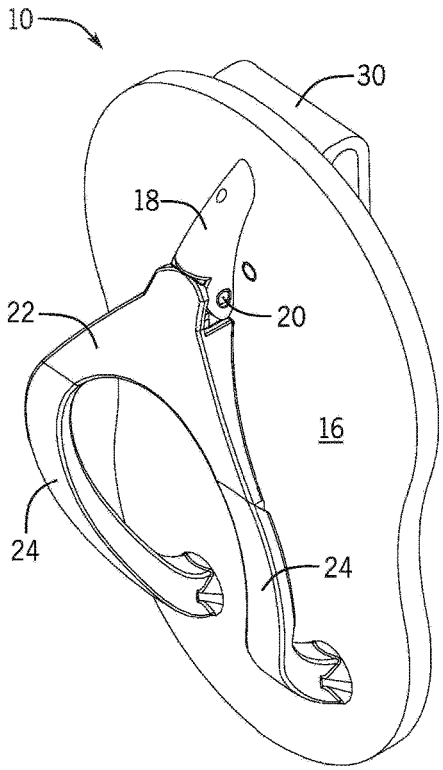
FIG. 2 is a rear perspective view of the sandal tote.
Figure 3:
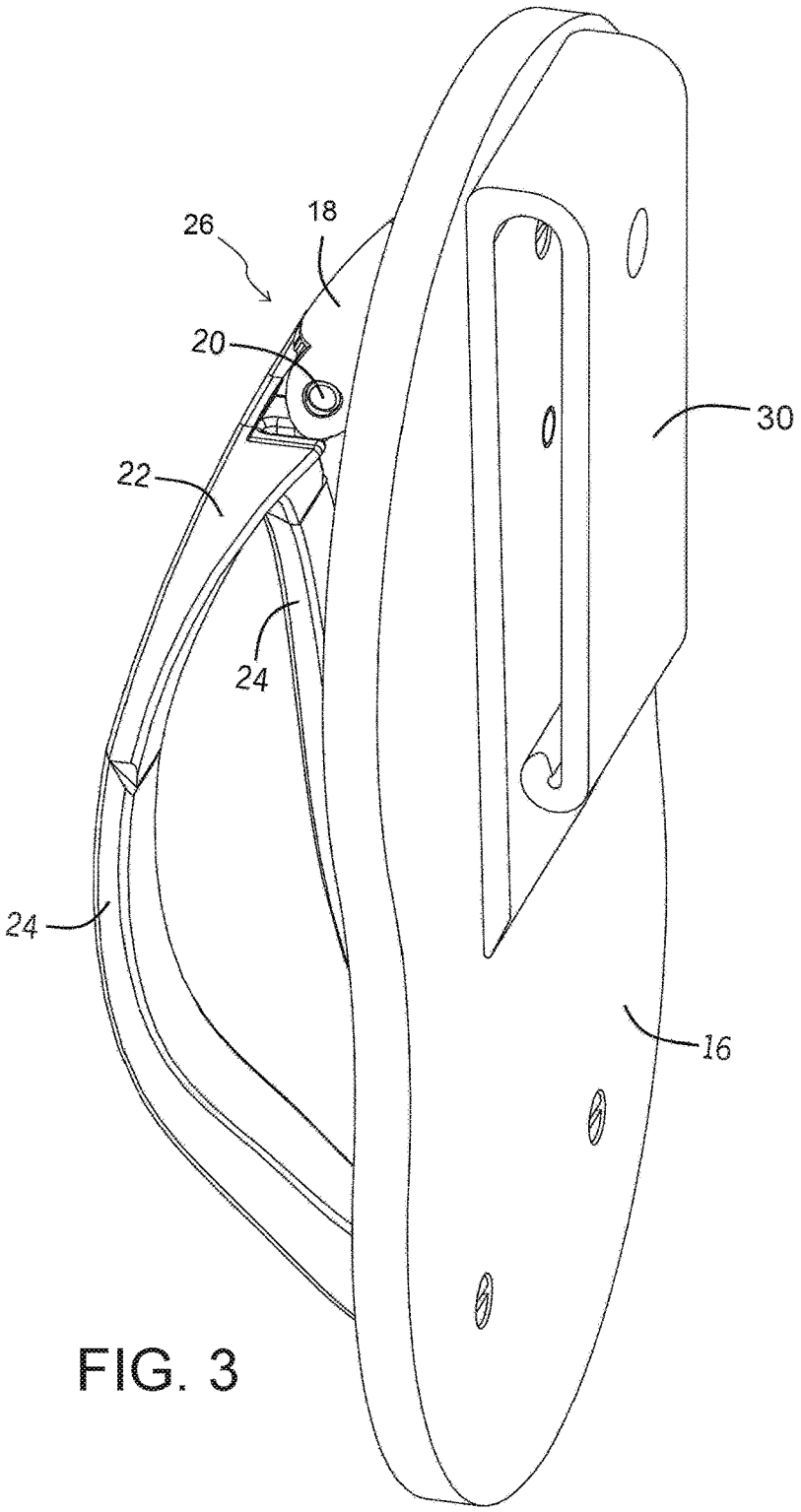
FIG. 3 is a front perspective view of the sandal tote.
Figure 4:
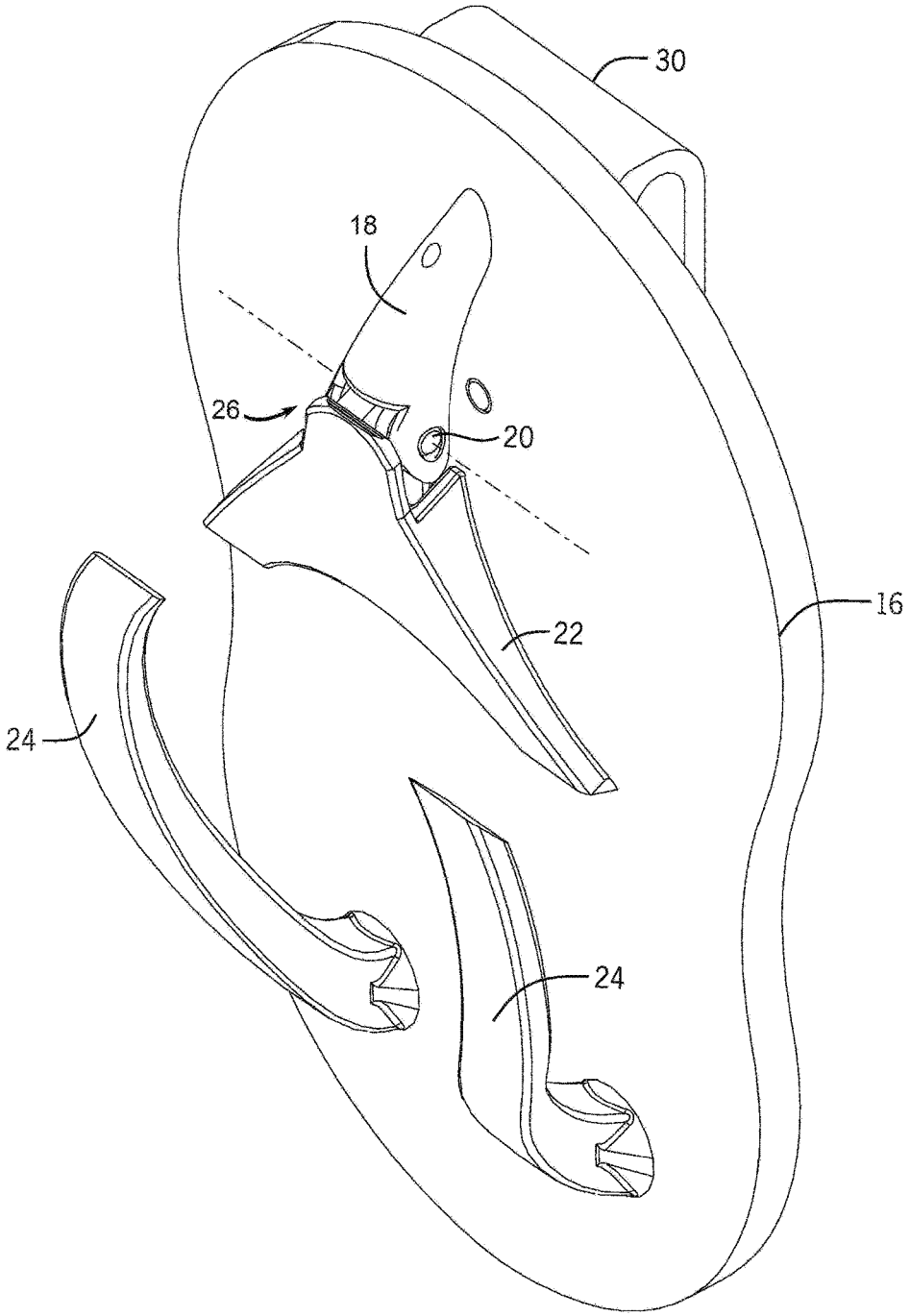
FIG. 4 is a rear perspective view of sandal tote in an open configuration.
Figure 6:
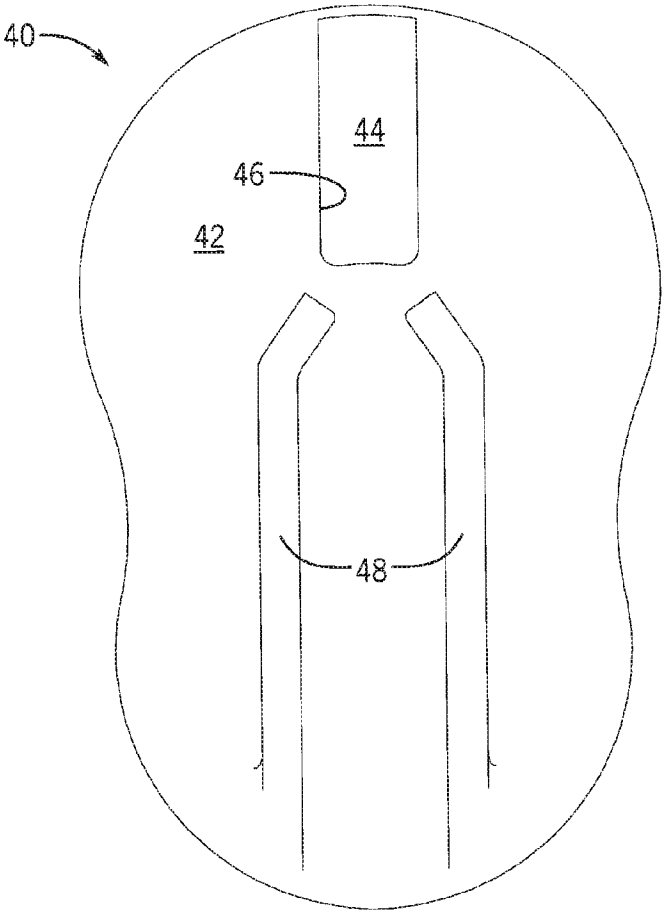
FIG. 6 is a front elevation view of the second embodiment.
Figure 5:
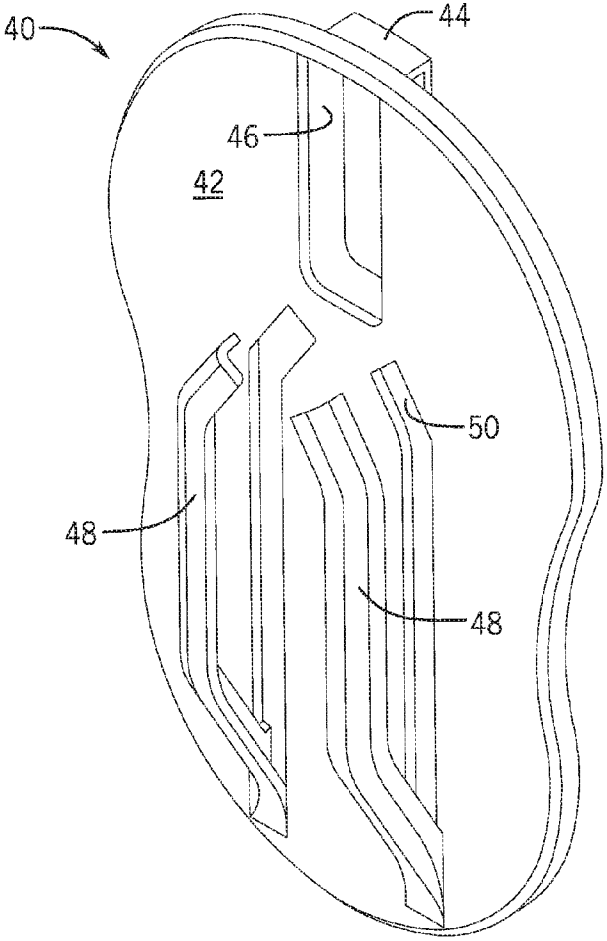
FIG. 5 is a perspective view of a second embodiment of a sandal tote.
Figure 7:
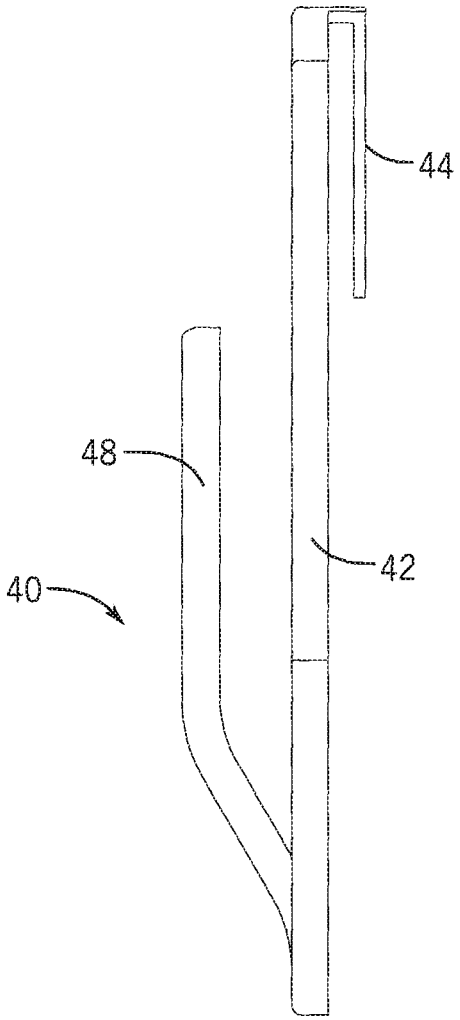
FIG. 7 is a right side elevation view of the second embodiment.
Figure 8:
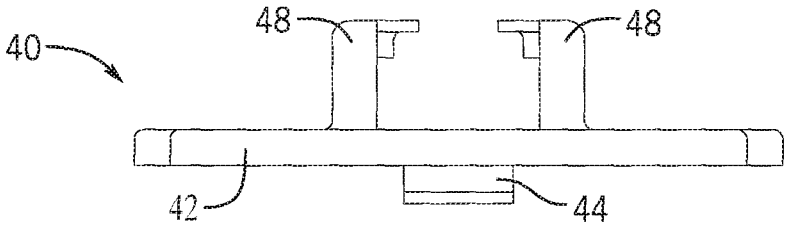
FIG. 8 is a bottom plan view of the second embodiment.

As seen in reference to FIGS. 2-4, the sandal tote 10 includes a base member 16 formed as a generally flat elongate body. The base 16 may be formed in any suitable shape, more preferably in the shape of a sandal sole. A pair of curvilinear hangers 24 extend upwardly and outwardly from a lower portion of a front surface of the base member 16. The hangers 24 have a first end attached to the base 16 and a second end that is separated from the base 16 so as to define a hanging nook between the hanger 24 and the base 16.

A pivoting latch assembly 26 may include a latch arm 22 that is operable between a closed secure position and an open release position. The latch assembly 26 is preferably formed in a generally inverted Y shape, with the lower ends of the latch arms 22 forming the diverging arms of the Y. In the closed position, the lower ends of the latch arms 22 are positioned in abutment with the second end of the hangers 24. In the open position, the latch arms 22 pivot away from the second ends of the hangers 24 to provide access to the hanging nook.

The pivoting latch assembly 26 may also include a pivot arm 18 having a first end attached to the base 16 and a second end that is coupled to the junction between the latch arms 22 at a pivot 20. The pivot arm 18 is elevated from the base at a position above the hangers 24, and may extend downwardly towards the hangers 24. The pivot arm 18 and latch arms 22, are preferably formed to mimic the shape and appearance of a Y shaped sandal strap. The latch arms 22 are biased away from the base 16 via a spring contained within the pivot 20.

The second ends of the hangers 24 may preferably have an angled face that slopes inwardly to face towards the base member 16. The ends of the latch arms 22 may have a complementing angled face that slopes outwardly to face away from the base member 16. By this arrangement, the second ends of the hangers 24 form a stop against which the latch arms 22 are urged by the spring contained in the pivot 20.

The sandal tote 10 may also include a retaining clip 30 secured to a back surface of the base member 16. The clip 30 defines a channel, or slot that is adapted to secure the sandal tote 10 to an article of clothing or other surface. For example, the clip 30 may attach to a user's belt, sash, pocket opening, waistband, and the like. The clip 30 may also attach to any suitable structure, such as a chair that may be located at a resort pool, a shade on the beach, and the like.

An alternative embodiment of a sandal tote may be seen in reference to FIGS. 5-8. In this embodiment, the sandal tote 40 has a base portion 42, preferably shaped like a sandal sole. A clip 44 extends from a back surface of the base portion 42 and is adapted to secure the tote 40 to a belt, item of apparel, or other engagement surface. A slot 46 is formed through the face of the base portion, substantially conforming to the shape of the clip portion 44. A pair of curvilinear hangers 48 having a first end that extends upwardly and outwardly from a lower portion of a front surface of the base portion 42. The hangers 48 have a second end that has inwardly turned arms that converge along a longitudinal centerline of the base portion 42. A pair of slots 50 are defined through a surface of the base portion 42 as mirror images of the hangers 48. The hangers 48 are adapted to receive a strap of the sandals or item to be carried by the sandal tote 40.

The sandal tote 10 of the present invention is simple to use. The sandal tote 10 attaches to an article of the user's apparel utilizing the clip 30 on the underside of the sandal tote 10. Once the sandal tote is attached, the user may push on the latch arms 22 which retract to expose the two hanger ends 24, allowing the user to slip their sandal straps 15 over the hangers 24. The user would then release the latch arms 22 and the spring pivot 20 would urge the latch arms 22 against the hangers 24, thereby securing the items and allowing the user to have hands free carriage of their sandals 14. While the invention has been described for retaining and carrying a pair of sandals 14, the sandal tote 10 of the present invention may be utilized to conveniently carry a variety of small items.

It should be understood, of course, that the foregoing relates to exemplary embodiments of the invention and that modifications may be made without departing from the spirit and scope of the invention as set forth in the following claims.

What is claimed is:

1. A sandal tote comprising:

an elongate base member having a front surface and a back surface;

a pair of hangers having a first end attached to the base member front surface, the pair of hangers extending outwardly from the base member front surface;

a pivoting latch assembly having pair of diverging latch arms pivotally disposed to a pivot arm, wherein the latch arms are operable between an open position and a closed position, such that in the closed position a second end of the pair of latch arms are in abutment with an upper end of the pair of hangers and in the open position the second end of the pair of latch arms are positioned towards the base member.

2. The sandal tote of claim 1, wherein the pivoting latch assembly further comprises:

a spring to bias the pair of latch arms in the closed position.

3. The sandal tote of claim 2, further comprising:

an angled face defined on a second end of the pair of hangers and angled to face towards the front surface of the base member.

4. The sandal tote of claim 3, further comprising:

a complementary angled face defined on a second end of the latch arms angled to abut with the angled face of the pair of hangers.

5. The sandal tote of claim 4, further comprising:

a retaining clip attached to a back surface of the base member.

6. The sandal tote of claim 5, wherein the base member is formed in the shape of a sandal sole.

7. The sandal tote of claim 6, wherein the latch assembly is formed in an inverted generally Y shape, with the pair of diverging latch arms forming the arms of the Y and the pivot arm forming the base of the inverted Y.

8. A tote assembly, comprising:

a base member formed in the shape of a sandal sole;

a plurality of hangers extending upwardly from a front surface of the base; and a latch assembly attached to a front surface of the base member, the latch assembly comprising a plurality of diverging latch arms having a first end pivotally attached to a pivot post and a second end biased in abutment with an upper end of the plurality of hangers in a closed position.

9. The tote assembly of claim 8, further comprising:

a retaining clip attached to a back surface of the base member.

10. The sandal tote of claim 8, further comprising:

an angled face defined on a second end of the pair of hangers and angled to face towards the front surface of the base member.

11. The sandal tote of claim 10, further comprising:

a complementary angled face defined on a second end of the latch arms angled to abut with the angled face of the pair of hangers.

12. The sandal tote of claim 8, wherein the plurality of diverging latch arms are operable towards the base member to an open position.

* * * * *